US009327252B2

(12) United States Patent
Lane et al.

(10) Patent No.: US 9,327,252 B2
(45) Date of Patent: May 3, 2016

(54) COMPACT DEVICE FOR ENHANCING THE MIXING OF GASEOUS SPECIES

(71) Applicant: APPLIED MATERIALS, INC., Santa Clara, CA (US)

(72) Inventors: John W. Lane, San Jose, CA (US); Berrin Daran, San Jose, CA (US); Ramachandra Murthy Gunturi, Banaglore (IN); Mariusch Gregor, Gilroy, CA (US); Bhaswan Manjunath, Bangalore (IN); Prashanth Vasudeva, Bangalore (IN)

(73) Assignee: APPLIED MATERIALS, INC., Santa Clara, CA (US)

( * ) Notice: Subject to any disclaimer, the term of this patent is extended or adjusted under 35 U.S.C. 154(b) by 530 days.

(21) Appl. No.: 13/834,625

(22) Filed: Mar. 15, 2013

(65) Prior Publication Data

US 2014/0269156 A1 Sep. 18, 2014

(51) Int. Cl.

| | |
|---|---|
| ***B01F 5/00*** | (2006.01) |
| ***B01F 5/06*** | (2006.01) |
| ***B01F 15/04*** | (2006.01) |
| ***B01F 3/02*** | (2006.01) |

(52) U.S. Cl.

CPC ..... *B01F 5/0077* (2013.01); *B01F 3/028* (2013.01); *B01F 5/0689* (2013.01); *B01F 15/0429* (2013.01); *B01F 2215/0096* (2013.01)

(58) Field of Classification Search

CPC ..... B01F 5/0077

USPC ..... 366/181.5, 336, 338, 340; 48/180.1, 48/189.4

See application file for complete search history.

(56) References Cited

U.S. PATENT DOCUMENTS

| | | | | |
|---|---|---|---|---|
| 1,924,038 | A * | 8/1933 | Herbsman | G05D 11/132 251/118 |
| 1,992,581 | A * | 2/1935 | Reeder | G05D 23/132 137/606 |
| 3,089,683 | A * | 5/1963 | Thomas et al. | B01F 3/10 138/42 |
| 3,924,989 | A * | 12/1975 | Althausen | B29C 33/0072 264/45.5 |
| 6,068,703 | A | 5/2000 | Chen et al. | |
| 6,386,750 | B2 * | 5/2002 | Marelli | B01F 3/0807 366/150.1 |
| 7,513,681 | B2 * | 4/2009 | Kingsford | B01F 5/0644 137/599.01 |
| 7,540,305 | B2 | 6/2009 | Strang | |
| 8,568,529 | B2 | 10/2013 | Ishikawa et al. | |
| 2005/0092247 | A1 | 5/2005 | Schmidt et al. | |
| 2007/0019503 | A1 * | 1/2007 | Kingsford | B01F 5/0644 366/336 |
| 2009/0120364 | A1 | 5/2009 | Suarez et al. | |
| 2011/0006463 | A1 | 1/2011 | Layman | |

OTHER PUBLICATIONS

International Search Report and Written Opinion mailed Jun. 23, 2014 for PCT Application No. PCT/US2014/017577.

* cited by examiner

*Primary Examiner* — David Sorkin

(74) *Attorney, Agent, or Firm* — Moser Taboada; Alan Taboada

(57) ABSTRACT

Apparatus and system for mixing gas comprising a first valve coupled to a first conduit controlling flow of a first gas, a second valve coupled to a second conduit controlling flow of a second gas, a controller controlling the valves, a base block with a first gas input coupled to the first conduit, a second gas input coupled to the second conduit and an output opening, a mixing chamber formed within the base block, wherein the mixing chamber is coupled to the first gas input and the second gas input to receive input gases, an inner block disposed within the mixing chamber, the inner block including a body with an inner volume and one or more perimeter holes formed through the body coupling the mixing chamber to the inner volume of the inner block; and a gas outlet configured to flow gas through the output opening of the base block.

16 Claims, 6 Drawing Sheets

COMPACT DEVICE FOR ENHANCING THE MIXING OF GASEOUS SPECIES

FIELD

Embodiments of the present invention generally relate to semiconductor substrate processing.

BACKGROUND

In semiconductor processing equipment, multiple gas species are often input into a common manifold before being introduced to the reaction chamber. A homogeneous mixture of the gas species is typically required to ensure substrate process uniformity and repeatability. However, stand alone component gas mixers adversely affect the size of the gas panel, are difficult to retrofit, increase response characteristics and can cause condensation of low vapor pressure gases.

Therefore, the inventors have provided improved apparatus for enhancing the mixing of gaseous species in semiconductor processing equipment.

SUMMARY

A compact gas mixer for enhancing the mixing of gaseous species in semiconductor processing equipment are provided herein. In some embodiments, the compact gas mixer includes a base block including a first gas input, a second gas input, and an output opening, with at least two inputs corresponding to at least two gases, the base block forming a mixing chamber formed within the base block, wherein the mixing chamber is fluidly coupled to the first gas input and the second gas input to receive input gases. The mixer further includes an inner block disposed within the mixing chamber, the inner block comprising: a body having an inner volume, one or more perimeter holes formed through the body fluidly coupling the mixing chamber to the inner volume of the inner block. A gas outlet is configured to flow gas through the output opening of the base block.

In some embodiments, a compact gas mixer includes a base block including a mixing chamber disposed within the base block, a first gas input disposed on a first side of the base block and coupled to the mixing chamber, a second gas input disposed on an opposing second side of the base block and coupled to the mixing chamber, a pass through conduit disposed through the base block from the first side to the second side and not coupled to the mixing chamber, and an output opening disposed on an end of the base block between the first side and the second side; and an inner block disposed within and spaced apart from walls of the mixing chamber, the inner block having an inner volume and a gas outlet coupled to the inner volume to flow gas from the inner volume through the output opening of the base block, wherein the inner block further includes one or more perimeter holes formed through the body and fluidly coupling the mixing volume of the mixing chamber to the inner volume of the inner block to provide a fluid path from the first and second gas inputs to the output opening.

In some embodiments, a system for mixing gas may include a first valve coupled to a first conduit controlling flow of a first gas and a second valve coupled to a second conduit controlling flow of a second gas. The system further includes a base block with a first gas input coupled to the first conduit, a second gas input coupled to the second conduit and an output opening, and a mixing chamber formed within the base block, wherein the mixing chamber is fluidly coupled to the first gas input and the second gas input to receive input gases. An inner block disposed within the mixing chamber, the inner block comprising: a body having an inner volume, one or more perimeter holes formed through the body fluidly coupling the mixing chamber to the inner volume of the inner block; and a gas outlet configured to flow gas through the output opening of the base block.

Other and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1A:
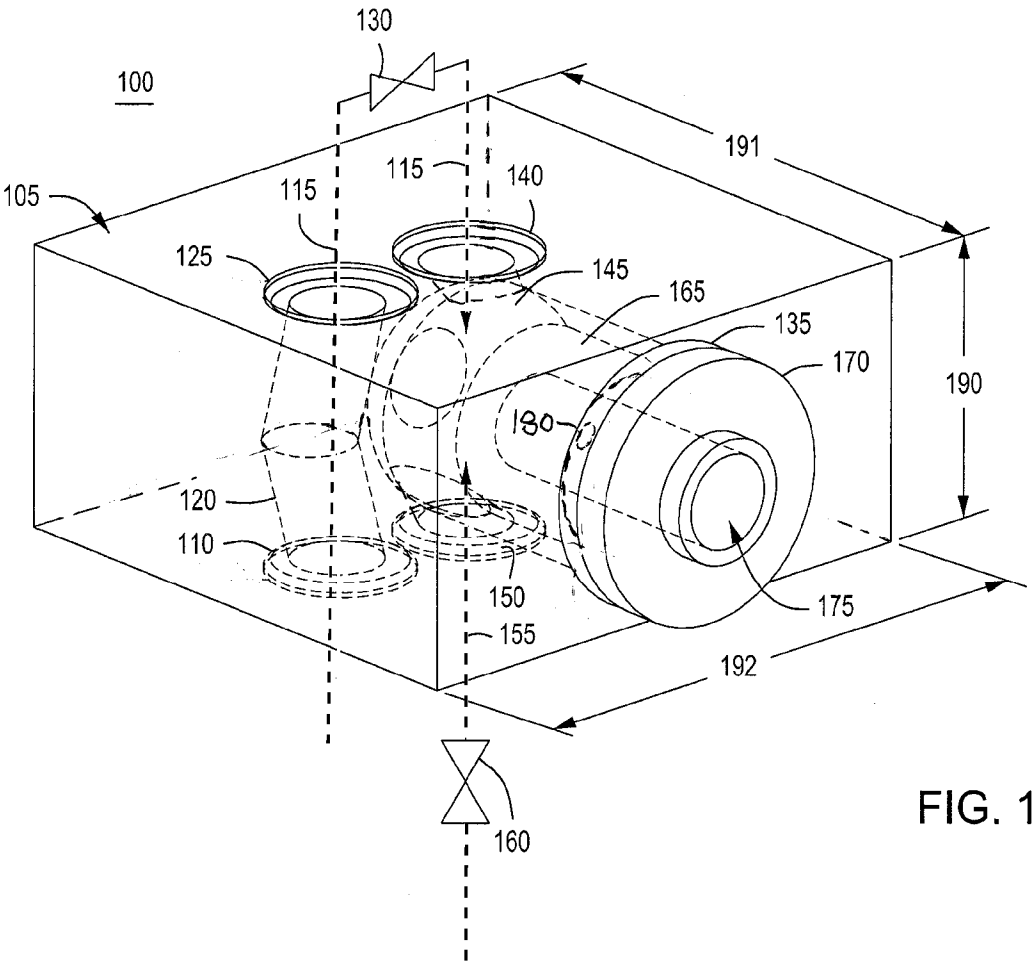
FIG. 1A depicts an isometric view of a mixer in accordance with some embodiments of the present invention.

To facilitate understanding, identical reference numerals have been used, where possible, to designate identical elements that are common to the figures. The figures are not drawn to scale and may be simplified for clarity. In this document, relational terms such as first and second, top and bottom, and the like may be used solely to distinguish one entity or action from another entity or action without necessarily requiring or implying any actual such relationship or order between such entities or actions. It is contemplated that elements and features of one embodiment may be beneficially incorporated in other embodiments without further recitation.

DETAILED DESCRIPTION

Embodiments of the present invention enhance homogeneous mixing of gaseous species in a compact form and are described below.

FIG. 1A depicts an isometric view of a compact mixer system 100 in accordance with some embodiments of the present invention. Note, phantom lines may be shown for clarity purposes. In some embodiments, the compact mixer system 100 may include a base block 105, an inner block 165, and an outlet block 170. In some embodiments, the base block 105 includes a first bottom input opening 110 (also referred to as a first gas input), a second bottom input opening 150 (also referred to as a second gas input), a top output opening 125, a top input opening 140, a mixing chamber (e.g. manifold) 145, and an outlet opening 135. A first gas 115 can be flowed into the base block 105 via first bottom input opening 110, and a second gas 155 can be flowed into the base block 105 via second bottom input opening 150. The first and second bottom input openings 110, 150 in some embodiments may be coupled input conduits (not shown) that supply the first and second gases 115, 155 to base block 105. In such embodiments, base block openings using o-rings or other types of seals to prevent gas leakage. In some embodiments, the compact mixer may be referred to as a sandwich mixer.

In some embodiments, the base block 105 may include a pass through conduit 120 that fluidly couples the first bottom input opening 110 to the top output opening 125. In some embodiments, the first gas 115 flows through the base block 105 at the first bottom input opening 110 to a top output opening 125 via pass through conduit 120 prior to reaching a first valve 130. In some embodiments, the pass through conduit 120 may bent or angled to avoid any interference with the gas mixing chamber 145 volume. The first valve 130 may be controlled by a controller (shown in FIG. 4) to regulate the amount of the first gas 115 that is introduced into the mixing chamber 145 to the top input opening 140. In an alternative embodiment, the first gas 115 may be input directly to the base block 105 and the mixing chamber 145 via the top input opening 140 from the first valve 130. In such an embodiment, there is no pass through conduit 120 and the first gas is directly injected into the mixing chamber 145.

The second bottom input opening 150 allows gas to enter the mixing chamber 145 controlled by a second valve 160. The second valve 160 may be controlled by a controller (shown in FIG. 5) to regulate the amount of the second gas 155 that is introduced into the mixing chamber 145 through the bottom input opening 150. Gases in the mixing chamber 145 may be comprised of a single gas or mixed gases depending on the control of the first valve 130 and the second valve 160. In some embodiments, the first valve 130 may control an input of an inert gas and the second valve 160 may control input of a toxic gas in the mixing chamber 145. In some embodiments, the gas or gas mixture in the mixing chamber 145 passes to the inner block 165 through a series of perimeter ventilation holes 180 leading to the interior (comprising a blind hole) of the inner block 165. The details of the inner block 165 will be discussed further below with FIGS. 2A and 2B. The gas mixture leaves the interior of the inner block 165 via outlet hole 175 on the outlet block 170. In some embodiments, the perimeter ventilation holes may be substantially circular or elliptical.

In some embodiments, the openings 125 and 140 at the top of the compact mixer system 100 may be retrofitted to couple to another block that may contain the first valve 130. The compact mixer system 100 is thus modular for retrofitting into larger devices. In embodiments described above, the openings (110, 125, 140, 150) determine gas flow input directions while the outlet hole 175 would be the output flow.

In some embodiments, base block 105 may have a height 190 of about 10 mm to about 20 mm. In some embodiments, base block 105 may have a width 192 of about 1 mm to about 10 mm. In some embodiments, base block 105 may have a depth 191 of about 1 mm to about 10 mm. In some embodiments, the base block 105 may provide a gas flow rate output at the outlet hole 175 of about 0.001 slm to about 100 slm.

Exemplary embodiments of compact mixer system 100 may advantageously provide one or more of the following benefits: minimum impact on the overall design footprint (which allows easy retrofit on existing designs and minimizes any impact on the size of the enclosure), minimum impact on the manifold volume (which minimizes impact on the response characteristics of the gas delivery system), and minimum impact on the differential pressure (which minimizes impact on response characteristics and minimizes issues associated with low vapor pressure gases). Exemplary embodiments of compact mixer system 100 may be retrofitted to existing systems through surface mounting seals to prevent gas leakage and to retain the compact mixer system 100 in place.

Figure 1B:
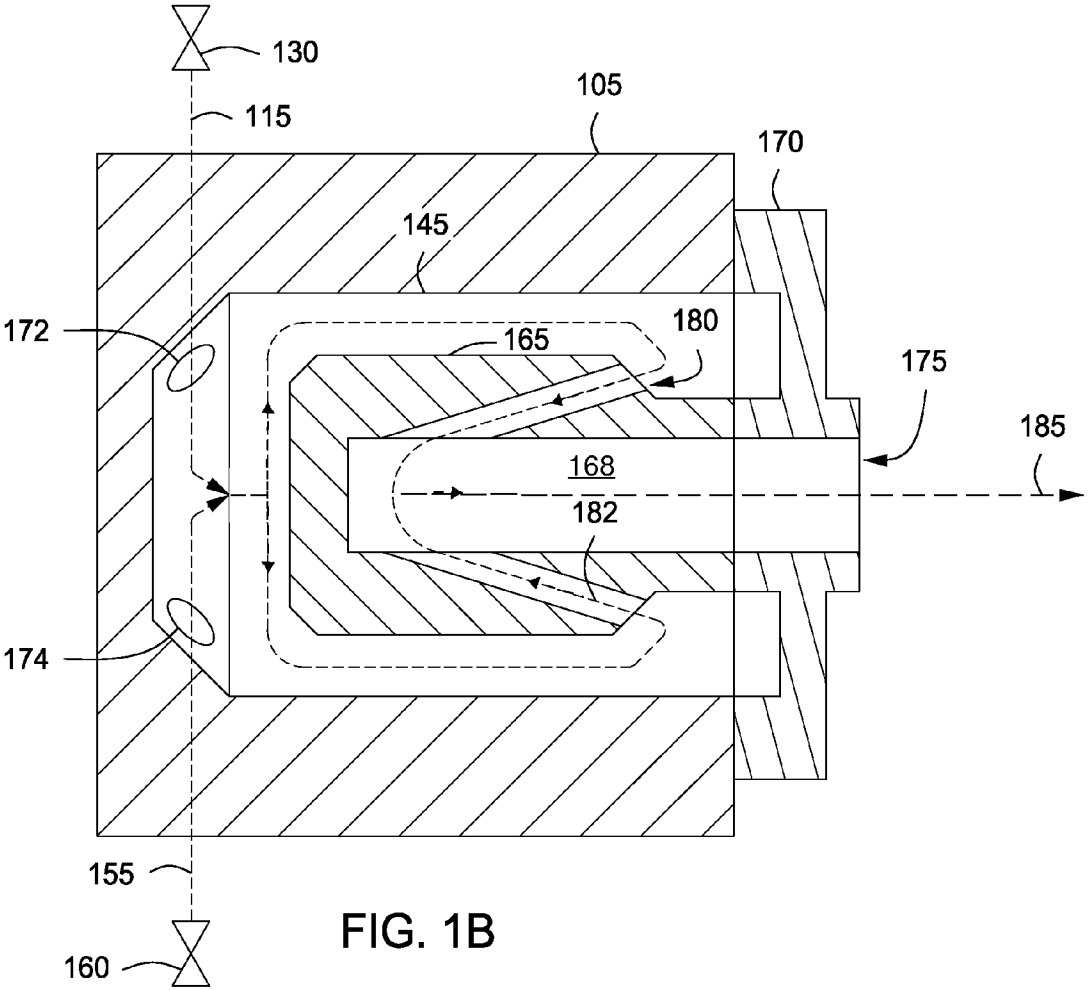
FIG. 1B depicts a schematic side cross-section view of the mixer in accordance with some embodiments of the present invention in FIG. 1A.

FIG. 1B depicts a side cross-section view of the mixer system 100 in accordance with some embodiments of the present invention in FIG. 1A. In some embodiments, the compact mixer system 100 may includes the base block 105, the inner block 165, and the outlet block 170. In some embodiments, the inner block 165 comprises an inner chamber 168 coupled to the outlet hole 175.

In some embodiments, the base block 105 may include a pass through conduit 120 that fluidly couples the first bottom input opening 110 to the top output opening 125. In some embodiments, the first gas 115 flows through the base block 105 and controlled by the first valve 130 to regulate the amount of the first gas 115 that is introduced into the mixing chamber 145 via a first inlet opening 172 coupled to the top input opening 140 (e.g. via a conduit). In an alternative embodiment, the first gas 115 may be input directly to the base block 105 and the mixing chamber 145 via the top input opening 140 from the first valve 130.

The second bottom input opening 150 (shown in FIG. 1A) allows gas to enter the mixing chamber 145 as controlled by a second valve 160 via a second inlet opening formed in the mixing chamber 145. The second valve 160 may be controlled by a controller (shown in FIG. 5) to regulate the amount of the second gas 155 that is introduced into the mixing chamber 145 through the bottom input opening 150. Gases in the mixing chamber 145 may be comprised of a single gas or mixed gases depending on the control of the first valve 130 and the second valve 160. In some embodiments, the first valve 130 may control an input of an inert gas and the second valve 160 may control input of a toxic gas in the mixing chamber 145.

The first gas 115 and second gas 155 mix in the mixing chamber to ultimately form and output the mixed gas 185. In some embodiments, the gas or gas mixture in the mixing chamber 145 passes to the inner block 165 through a series of perimeter ventilation holes 180 coupled to gas channels 182 formed within the inner block 165. The gas channels 182 lead to the interior inner chamber 168 (comprising the blind hole) of the inner block 165. The details of the inner block 165 will be discussed further below with FIGS. 2A and 2B. The mixed gas 185 passes from the mixing chamber 145 to an inner chamber 168 via ventilation holes 180 and gas channels 182 formed in the inner block 165. The mixed gas leaves the inner chamber 168 of the inner block 165 via outlet hole 175 on the outlet block 170. In some embodiments, the gas channels 182 may be sloped or inclined at a selected angle to for greater gas fluidity.

Figure 2B:
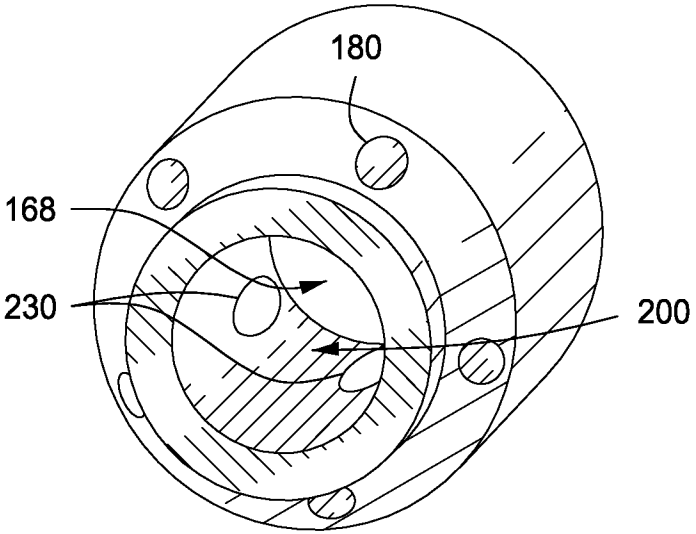
FIGS. 2A and 2B depict two isometric views of an inner block of the mixer in accordance with some embodiments of the present invention.
Figure 2A:
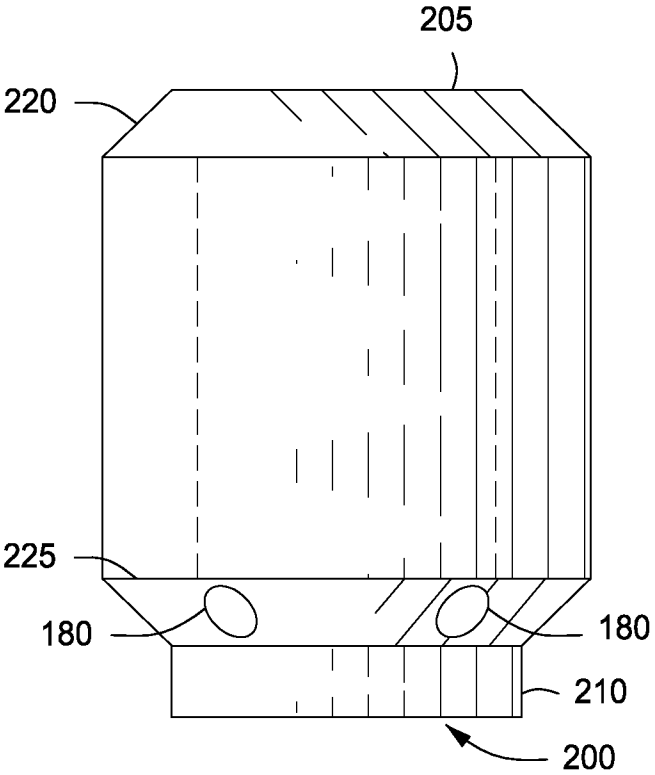

FIGS. 2A and 2B depict two isometric views of the inner block 165 of the mixer in FIGS. 1A and 1B in accordance with some embodiments of the present invention. In FIG. 2A, the inner block 165 is substantially cylindrical with an gas outlet end 200 and a closed end 205 that form an inner chamber 168 (as shown in FIG. 2B) of the inner block 165. Although shown and described as substantially cylindrical, in some embodiments, the inner block 165 may be spherical, rectangular, or any other suitable geometries that provide mixing capabilities described herein. The inner block 165 further comprises a first beveled edge 220, a second beveled edge 225, and a collar 210. The first beveled edge 220 proximate the closed end 205 and the second beveled edge 225 distal to the closed end 205. The second beveled edge 225 comprising the series of perimeter ventilation holes 180 allowing gas to enter the inner chamber 168 of the inner block 165. In some embodiments, the perimeter ventilation holes 180 are angled holes at an inclined angle of about 15 to 17.5 degrees for maximum flow rate and to create a small vortex. The small size of the perimeter ventilation holes 180 ensures entering gases contact and reflect off of the closed end 205 before leaving the gas outlet end 200. The collar 210 couples to the outlet block 170 that will be further discussed with respect to FIGS. 3A and 3B.

FIG. 2B illustrates an alternative isometric view of the inner block 165 depicting the perimeter ventilation holes 180 forming channels to the inner chamber 168 via through holes 230. The gas entering the inner chamber 168 exit the inner block through the collar that forms around the gas outlet end 200 leading to outlet block 170.

Figure 3B:
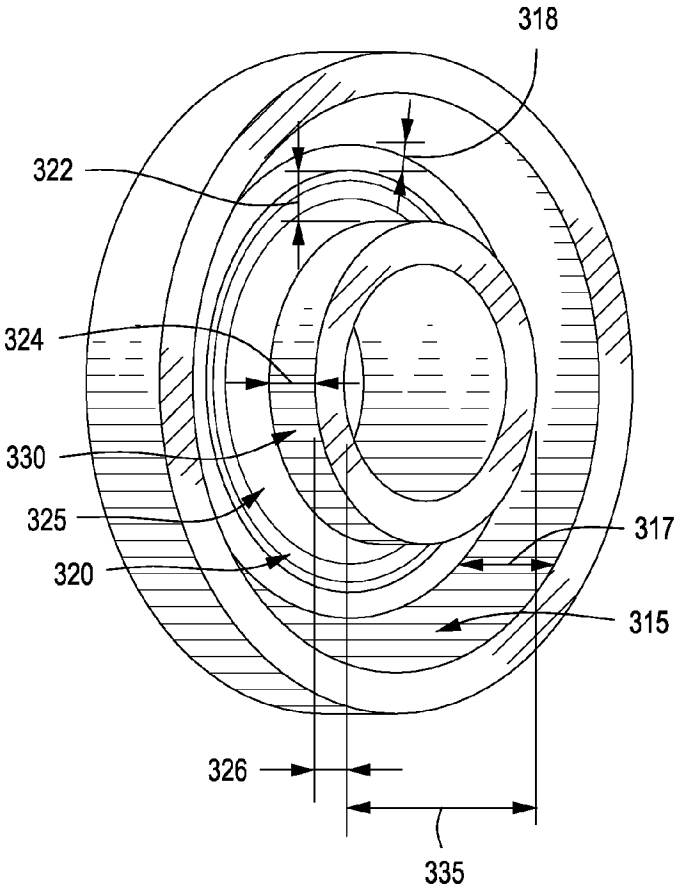
FIGS. 3A and 3B depict two isometric views of an outlet block of the mixer in accordance with some embodiments of the present invention.
Figure 3A:
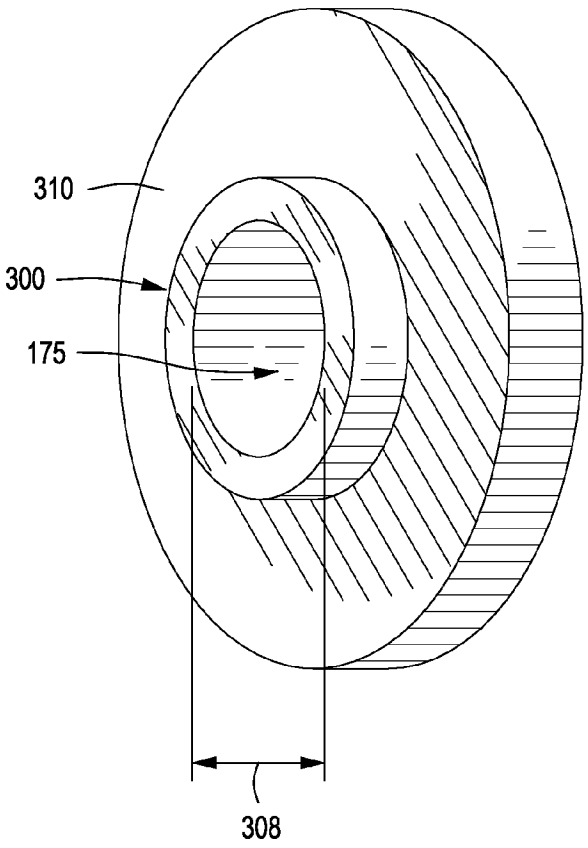

FIGS. 3A and 3B depict two isometric views of the outlet block of the mixer in FIGS. 1A and 1B in accordance with some embodiments of the present invention. FIG. 3A provides an exterior view of the outlet block 170. In an embodiment, the outlet block 170 is substantially circular with flat surface 310. The outlet collar 300 may have an internal diameter 308 selected based on the gas flow rate desired. Extending from the flat surface 310 is a raised collar 300 of an exemplary width that is also substantially circular and forms the outlet hole 175. The outlet hole 175 in some embodiments will be coupled to a flow rate controller that will be discussed in further detail below with respect to FIG. 4. In some embodiments, the outlet block is formed from one piece.

FIG. 3B provides an interior view of the outlet block 170. The interior of the outlet block 170 comprises a first contoured ring 315 having a width 317 and a second contoured ring 325 having a width 322 that are separated by a flattened area 320 having a width 318. The widths 317, 318 and 322 may be selected based on the outlet opening 135 configuration in addition to machining and space constraints and requirements. The flattened area 320 couples with the flat edge of the collar 210. The interior of the outlet block 170 further includes an interior collar 330 with a smaller diameter 335 than the collar 210 of the inner block 165. The interior collar 330 may have a height 324 and a width 326 selected based on the collar 210 configuration such that it is small enough to fit into the collar 210 of the inner block 165. In some embodiments, the outlet block 170 is welded to the collar 210 of the inner block 165 that is also welded to the compact mixer system 100.

Figure 4B:
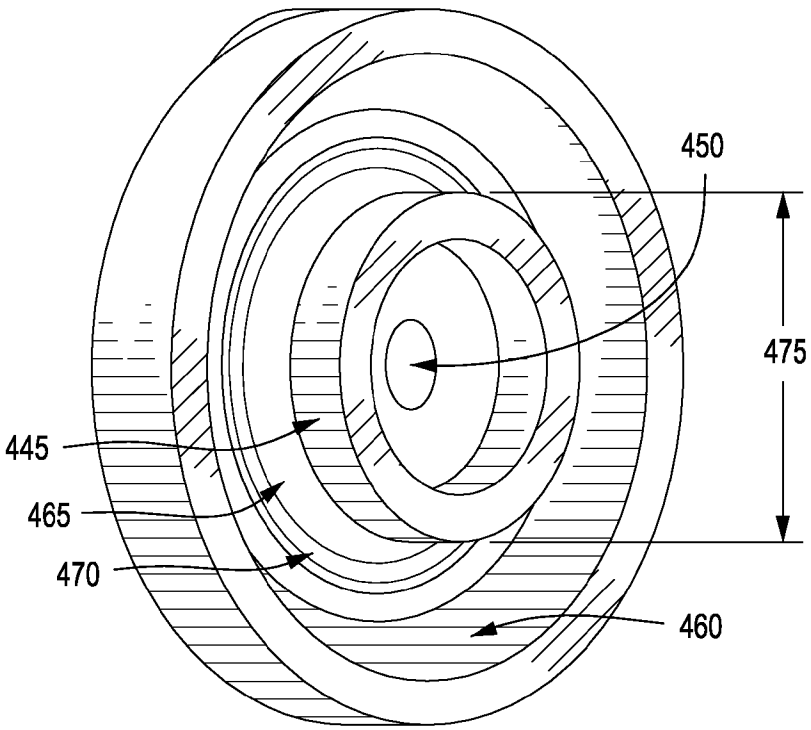
FIGS. 4A and 4B depict two isometric views of an eccentric outlet block in accordance with some embodiments of the present invention.
Figure 4A:
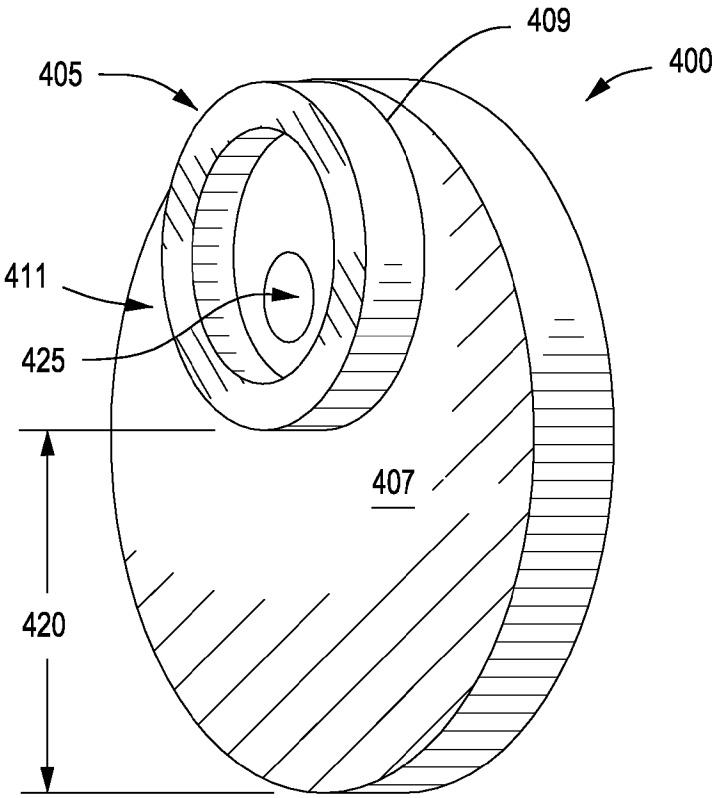

FIGS. 4A and 4B depict two isometric views of the outlet block of the mixer in FIGS. 1A and 1B in accordance with some embodiments of the present invention. FIG. 4A provides an exterior view of eccentric outlet block 400 that may replace the outlet block 170 of FIGS. 1A and 1B. The eccentric design allows for a reduction in fittings to retrofit with other devices (such as mixers) and the angle of through holes 425 and 450 is selected based upon the location of the retrofitting. In some embodiments, the eccentric outlet block 400 is substantially circular with flat exterior surface 407. An eccentric outlet collar 405 may be mounted to (or formed thereon) the exterior surface 407. One perimeter edge 409 of the eccentric outlet collar 405 is adjacent to the perimeter of the eccentric outlet block 400. A distal perimeter edge 411 of the eccentric outlet collar 405 having a distance 420 in some embodiments of 6.8 mm from the opposite radial end of the eccentric outlet block 400. Located within the interior diameter 430 is an elliptical outlet through hole 425 that in some embodiments may be the outlet hole 175 in FIGS. 1A and 1B.

The eccentric outlet through hole 425 in some embodiments will be coupled to a flow rate controller that will be discussed in further detail below with respect to FIG. 4. In some embodiments, the eccentric outlet block 400 is formed from one piece.

FIG. 4B provides a simplified interior view of the eccentric outlet block 400. The interior of the eccentric outlet block 400 comprises an centrally located interior eccentric collar 445 with an elliptical interior outlet through hole 450.

The interior of the eccentric outlet block further comprises a first contoured ring 460 and a second contoured ring 465 that are separated by a flattened area 470. The flattened area 470 couples with the flat edge of the collar 210. The interior of the eccentric outlet block 400 further includes the interior eccentric collar 445 with a smaller diameter 475 than the collar 210 of the inner block 165. The size of the interior eccentric collar 445 of the eccentric outlet block 400 is small enough to fit into the collar 210 of the inner block 165. In some embodiments, the outlet block 170 is welded to the collar 210 of the inner block 165 that is also welded to the compact mixer system 100.

Figure 5:
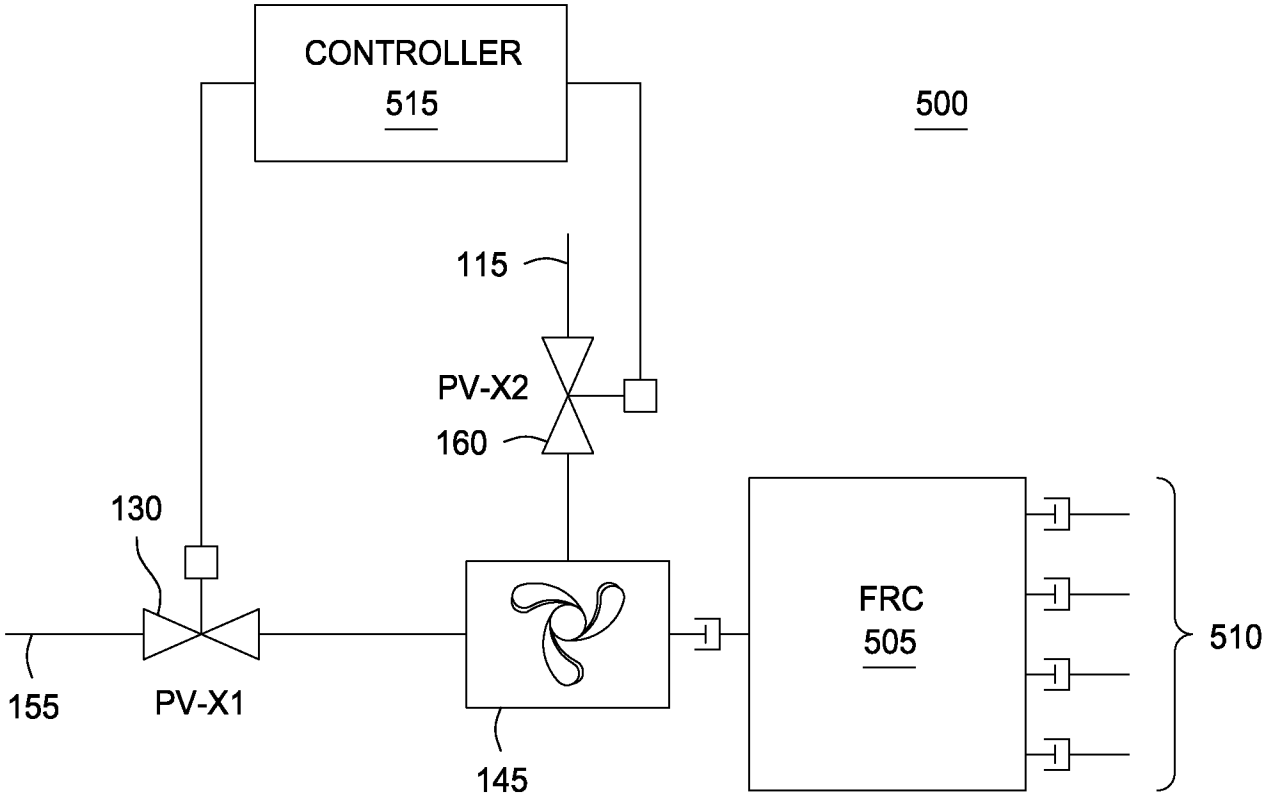
FIG. 5 depicts schematic block diagram showing an exemplary gas flow control system in accordance with some embodiments of the present invention.

FIG. 5 depicts schematic view of the mixer in FIGS. 1A and 1B in accordance with some embodiments of the present invention. FIG. 5 is an embodiment of a system 500 using the compact mixer system 100 of FIGS. 1A and 1B. The system 500 comprises a controller 515 controlling the first valve 130 that controls the flow of the first gas 115 into a mixing chamber 145 and the second valve 160 that controls the flow of the second gas 155 into the mixing chamber 145. The controller 515 comprising a microcontroller, memory, actuators, and the like to selectively actuate the first valve 130 and the second valve 160. The mixing chamber 145 outputting gas to the flow rate controller (FRC) 505. The FRC 505 outputting through a series of BCR fittings/connections 510. In some embodiments the FRC 505 may connect via VCR fittings.

While the foregoing is directed to embodiments of the present invention, other and further embodiments of the invention may be devised without departing from the basic scope thereof.

The invention claimed is:

1. A compact gas mixer, comprising:

a base block including a first gas input, a second gas input, and an output opening;

a mixing chamber having a mixing volume formed within the base block, wherein the mixing chamber is fluidly coupled to the first gas input and the second gas input to receive input gases; and an inner block disposed within the mixing chamber, the inner block comprising:

a body having an inner volume;

one or more perimeter holes formed through the body fluidly coupling the mixing volume of the mixing chamber to the inner volume of the inner block; and a gas outlet configured to flow gas through the output opening of the base block, wherein the one or more perimeter holes are formed at an inclined angle and extend from a periphery of the inner block proximate the gas outlet to the inner volume of the inner block proximate a closed end opposing the gas outlet of the inner block.

2. The compact gas mixer of claim 1, wherein the closed end and the gas outlet of the inner block are tapered.

3. The compact gas mixer of claim 1, wherein the first and second gas inputs are each respectively coupled to at least one control valve.

4. The compact gas mixer of claim 1, further comprising a pass through conduit disposed within the base block, the pass through conduit fluidly coupling a bottom surface of the base block to a top surface of the base block.

5. The compact gas mixer of claim 1, further comprising an outlet block having a collar disposed through the outlet opening of the base block and coupled to the gas outlet of the inner block to form a gas outlet channel.

6. The compact gas mixer of claim 5, wherein the outlet block seals the outlet opening of the base block about a periphery of the gas outlet of the inner block such that only gas from the inner block flows from the compact gas mixer.

7. The compact gas mixer of claim 5, wherein the outlet block is coupled to a flow rate controller.

8. A compact gas mixer, comprising:

a base block including a mixing chamber having a mixing volume disposed within the base block, a first gas input disposed on a first side of the base block and coupled to the mixing chamber, a second gas input disposed on an opposing second side of the base block and coupled to the mixing chamber, a pass through conduit disposed through the base block from the first side to the second side and not coupled to the mixing chamber, and an output opening disposed on an end of the base block between the first side and the second side; and an inner block disposed within and spaced apart from walls of the mixing chamber, the inner block having a body with an inner volume and a gas outlet coupled to the inner volume to flow gas from the inner volume through the output opening of the base block, wherein the inner block further includes one or more perimeter holes formed through the body and fluidly coupling the mixing volume of the mixing chamber to the inner volume of the inner block to provide a fluid path from the first and second gas inputs to the output opening.

9. The compact gas mixer of claim 8, further comprising an outlet block having a collar disposed through the outlet opening of the base block and coupled to the gas outlet of the inner block to form a gas outlet channel, wherein the outlet block is coupled to the base block along a perimeter of the outlet opening.

10. A system for mixing gas comprising:

a first valve coupled to a first conduit controlling flow of a first gas;

a second valve coupled to a second conduit controlling flow of a second gas;

a controller controlling the first valve and second valve;

a base block with a first gas input coupled to the first conduit, a second gas input coupled to the second conduit and an output opening;

a mixing chamber having a mixing volume formed within the base block, wherein the mixing chamber is fluidly coupled to the first gas input and the second gas input to receive input gases; and an inner block disposed within the mixing chamber, the inner block comprising:

a body having an inner volume;

one or more perimeter holes formed through the body fluidly coupling the mixing volume of the mixing chamber to the inner volume of the inner block; and a gas outlet configured to flow gas through the output opening of the base block, wherein the one or more perimeter holes are formed at an inclined angle and extend from a periphery of the inner block proximate the gas outlet to the inner volume of the inner block proximate a closed end opposing the gas outlet of the inner block.

11. The system of claim 10, wherein the controller is configured to selectively open and close the first and second valve to control ratio mixing of the first and second gases in the mixing chamber.

12. The system of claim 10, wherein the closed end and the gas outlet of the inner block are tapered.

13. The system of claim 10, wherein the first and second gas inputs are each respectively coupled to at least one control valve.

14. The system of claim 10, further comprising a pass through conduit disposed within the base block, the pass through conduit fluidly coupling a bottom surface of the base block to a top surface of the base block.

15. The system of claim 10, further comprising an outlet block having a collar disposed through the outlet opening of the base block and coupled to the gas outlet of the inner block to form a gas outlet channel, wherein the outlet block seals the outlet opening of the base block about a periphery of the gas outlet of the inner block such that only gas from the inner block is output via the outlet block.

16. The system of claim 15, wherein the outlet block is configured to output a mixed gas to a flow rate controller.

* * * * *